United States Patent [19]

Lohrmann et al.

[11] Patent Number: 4,881,838

[45] Date of Patent: Nov. 21, 1989

[54] PRINTING PLATEN

[75] Inventors: Gerhard Lohrmann, Thalfingen; Guenter Engelhardt, Niederstotzingen; Thomas Werner, Ulm, all of Fed. Rep. of Germany

[73] Assignee: Mannesmann AG, Duesseldorf, Fed. Rep. of Germany

[21] Appl. No.: 765,251

[22] Filed: Aug. 12, 1985

[30] Foreign Application Priority Data

Aug. 16, 1984 [DE] Fed. Rep. of Germany ..... 3430092

[51] Int. Cl.[4] ..... B41J 11/057

[52] U.S. Cl. ..... 400/662

[58] Field of Search ..... 400/662, 659, 661.1, 400/656, 657, 658, 661, 661.2

[56] References Cited

U.S. PATENT DOCUMENTS 1,347,333 7/1920 Houston ..... 400/661.2

4,242,003 12/1980 Ragen ..... 400/124

OTHER PUBLICATIONS

IBM Technical Disclosure Bulletin, vol. 23, No. 4, Sep. 1980, p. 1490, "Wear-Resistant Coating for Platens of Steel Belt Printers", by Matthaei.

*Primary Examiner*—David A. Wiecking

*Attorney, Agent, or Firm*—Ralf H. Siegemund

[57] ABSTRACT

A printing platen particularly for matrix printers is comprised of an aluminum or synthetic body carrying a thin layer of a ceramic material, preferably aluminum oxide, titanium oxide, chromium dioxide or a blend thereof. Such a platen is sufficiently frictional and hard for withstanding the impact of high speed print hammers or needles.

6 Claims, 1 Drawing Sheet

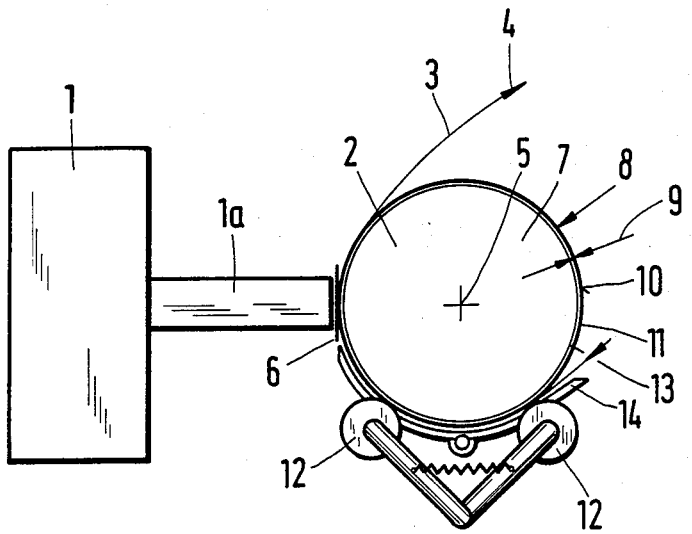
1
1a
2
3
4
5
6
7
8
9
10
11
12
12
13
14

PRINTING PLATEN

BACKGROUND OF THE INVENTION

The present invention relates to a platen for typing and printing machines, particularly matrix printers, wherein a basic support element is provided for transporting a print medium by means of friction.

Printing platens or platen drums are well known, and they are usually provided for air gap free support of paper or the like and they participate in driving and advancing such a print medium in a particular direction which is usually transversely to the direction of printing or, more precisely, of a printing line. The print medium may either be a single sheet or a basically endless web. Also, a single sheet as well as endless web kind of print medium may come in various layers and carbon paper or the equivalent is interposed. Generally this lack in uniformity of the print medium to be accomodated by one and the same printer poses problems because the conditions of friction and therefore the conditions of transport differ.

The platen used for example in ordinary typewriters but also used in some kind of matrix printers is often constructed as a rubber drum or particularly a synthetic drum in order to transport the print medium. Rubber drums as well as platen drums made of synthetic material have to have in either case a high surface friction. In the case of a matrix printer using print elements such as styli i.e. needles or printing hammers having particular points or print balls the situation is present that the force exerted by these impacting print elements is very high so that particularly with increasing speed of printing the hardness of the surface of the platen must be improved as compared with earlier versions. On the other hand it was found that if platen drums are made of a harder-than-rubber material, such as aluminum drums, the friction decreases. In other words increase in hardness has been to some extent compensated by a decrease in friction which then poses problems with regard to the reliability of transporting the print medium.

It can thus be seen that the state of the art is characterized by rubber or synthetic platen drums with relatively high friction for the transport but being limited to lower print speed, and alternatively there are metallic platens having a lower frictional value but being more suitable for higher print speeds because of a larger hardness and resistance against the high speed impact of the print elements.

Generally speaking print speeds have to be increased which is a trend in matrix printer engineering so that a metallic and very hard printing platen will ensure high quality of the characters being printed. But it was found that in such high speed printers the transport of the print medium may sometimes be insufficient amounting to a skewing of the paper. This problem was particularly noticed in case of single sheet feeding. On the other hand particularly in the case of line printers a precisely metered advance of the print medium particularly in the case of high speed printing, is a prerequisite for a good i.e. high quality, easily legible, so called near letter quality appearance of the printed characters.

DESCRIPTION OF THE INVENTION

It is an object of the present invention to provide a new and improved wearproof print platen for high print speeds, which is very hard on its surface but still exhibits high friction so that both, accurate and clear character image can be guaranteed and accurate transport of the paper will be effected.

In accordance with the preferred embodiment of the present invention it is suggested to provide a basic platen body which does not have to meet particular criteria with regard to hardness and friction but is simply an economical, manufacturable body element (e.g. aluminum). Upon this basic body a ceramic coating or layer is provided by means of plasma or flame spraying as the material should be amenable to being deposited in such fashion. The layer should have a thickness not smaller than 1/100 mm but being not necessarily thicker than 5 mm. Herein oxide ceramic materials are preferred being particularly for example aluminum oxide, titanium oxide or chromium oxide or a blend of these materials. These materials are amenable to plasma and/or flame spraying application and the surface of the resulting coating has indeed sufficient hardness, even for hard impact type printing as it is used in matrix printers. These oxides on the other hand exhibit an extremely high friction i.e. vis-a-vis the usual record and print carriers such as different grades and kinds of paper. The inventive wearproof platen drum guarantees therefore a clean and easily legible print appearance as well as definite transport conditions for the print medium even in the case of relatively high print speeds.

In accordance with the basic aspect of the invention, a printing platen can be made by using a cylindrical body and providing an oxide ceramic material onto that body under utilization of plasma application. The outer periphery is of a circular cross section. Any diameter variations or deviations of the base body from complete roundness can be compensated by the application process in which thickness variations of the layer establish ultimately a completely round outer surface. It was mentioned above that the layer should not be smaller than 1/100 mm, this being the practical minimum; a more realistic value is 0.02 mm.

As stated materials subject to spraying can be aluminum oxide, titanium oxide, or chromium oxide or a blend thereof. The desired adhesion of this coating to the basic body is obtainable if the basic drum is made of metal or a synthetic with normal surface. Additional features are to be seen in that the resulting cylindrical platen drum has basically a rough surface but it has also an axially limited, radially smoothed zones. This feature avoids abrasion of and by the usual paper deflection material when no paper is interposed.

DESCRIPTION OF THE DRAWINGS

While the specification concludes with claims particularly pointing out and distinctly claiming the subject matter which is regarded as the invention, it is believed that the invention, the objects and features of the invention of the invention and further objects, features and advantages thereof will be better understood from the following description taken in connection with the accompanying drawings in which:

THE FIGURE is a cross section through a platen drum and associated structure in accordance with the preferred embodiment of the present invention for practicing the best mode thereof.

Proceeding now to the detailed description of the drawings the printing platen illustrated herein is shown to cooperate with a matrix printhead 1 having a front extension or mouth piece portion 1a for accomodating the front parts or ends of styli. Platen drum 2 is shown in cross section. The print head 1 moves during printing in the direction transverse to the extension of the drawing. The platen drum has an axis 5 which extends in the same direction. Reference numeral 4 denotes an arrow indicating the advance of paper during the print process which motion occurs in the plane of the drawing. The paper or print medium is generally denoted by reference numeral 3. The motion in the direction of advance 4 will occur in between passes in steps or during a print pass on a continuous basis. In matrix printers the printhead 1 reciprocates back and forth in the direction parallel to the platen axis 5. The movement is usually a uniform one i.e. a constant speed motion until and up to the points of reversal. During these periods of constant motion print needles or hammers emerge in the selected pattern from the head portion 1*a* and hit an ink ribbon 6 to provide print dots on the other print medium 3 generally.

The print platen 2 in accordance with the preferred embodiment of the present invention is comprised of a basic drum body 7 made of aluminum or a synthetic material and carries an oxide ceramic material coating 8. Reference numeral 9 denotes the layer thickness which, as stated, is to be between 1/100 mm but not more than 5 mm, mm thick. This layer establishes the outer platen surface 10. The oxide ceramic material 8 has been applied by a spray process preferably a plasma or flame spraying process. Therefore the platen is established by the basic body 7 together with the coating 8 and the outer periphery of the coating 8 is to have an accurate circular profile and contour 11.

The coating material 8 in this case may be comprised of aluminum oxide, titanium oxide or chromium oxide or blend of these materials. As stated a uniform or circularity adapting thickness of .02 mm is preferred. The mode of application i.e. the spraying on of the oxide ceramic material 8 provide a peak-to-valley weight in the layer surface 10 which is particularly suited for the inventive purpose i.e. it is a coarseness establishing a certain roughness in the ceramic coating surface 10 by means of which the paper 3 can be advanced with certainty and in a manner as is known from a conventional rubber platen, but the hardness of this ceramic layer is considerably higher than the hardness in a conventional rubber or a synthetic platen drum.

The print medium such as paper 3 is urged by means of several pressure rolls 12 against the platen surface 10 to thereby cause the friction of the platen drum to become effective for purposes of paper transport. However a certain axially limited zone 13 is provided on this cylindrical platen drum to be radially smooth and against which bears a paper deflection device 14 without undue wear when paper is not situated in between.

The invention is not limited to the embodiments described above but all changes and modifications thereof, not constituting departures from the spirit and scope of the invention, are intended to be included.

We claim:

1. Platen in matrix dot printers, the platen being provided for printing and for the transport of the print medium, comprising:

a basic body of cylindrical configuration and a coating thereon having been applied by plasma or flame spraying, being considerably harder than rubber and having a thickness of not less than 1/100 mm but not more than 5 mm and providing a frictional surface for abutment with the print medium.

2. Platen as in claim 1 wherein said coating is an oxide ceramic material.

3. Platen as in claim 2 wherein said oxide ceramic material is aluminum oxide, titanium oxide, or chromium oxide or a blend of these materials.

4. Platen as in claim 1 wherein said basic body is made of metal or a synthetic.

5. Platen as in claim 1 and having smooth zones.

6. Method of using a cylindrical body having a coating being made by plasma or flame spraying to be considerably harder than rubber and having a thickness of not less than 1/100 mm but not more than 5 mm and providing a frictional surface for abutment with a print medium, the improvement of using said cylindrical body as printing platen in a matrix dot printer.

* * * * *